US005318658A

United States Patent [19]

Goodman

[11] Patent Number: 5,318,658

[45] Date of Patent: Jun. 7, 1994

[54] TAPING MACHINE

[75] Inventor: James A. Goodman, Glencoe, Ill.

[73] Assignee: Prototype Equipment Corporation, Lake Forest, Ill.

[21] Appl. No.: 56,023

[22] Filed: Apr. 30, 1993

[51] Int. Cl.[5] ..... B31F 5/08

[52] U.S. Cl. ..... 156/468; 156/475; 156/486; 156/492; 156/517; 156/521

[58] Field of Search ..... 156/517, 521, 187, 468, 156/475, 479, 480, 482, 486, 492

[56] References Cited

U.S. PATENT DOCUMENTS 2,232,729 2/1941 Randolph ..... 156/517 X 3,535,189 10/1970 Hall et al. ..... 156/486

3,546,045 12/1970 Califano et al. ..... 156/486

4,889,581 12/1989 Ulrich et al. ..... 156/522 X

*Primary Examiner*—David A. Simmons

*Assistant Examiner*—M. Curtis Mayes

*Attorney, Agent, or Firm*—Willian Brinks Hofer Gilson & Lione

[57] ABSTRACT

A carton taper machine that folds an end of the tape over on itself to produce a pull tab, cuts a length of tape, applies a first section of the length of tape to a first surface of a carton and a second section of the length of tape to a second surface of the carton which is at right angles to the first surface.

5 Claims, 3 Drawing Sheets

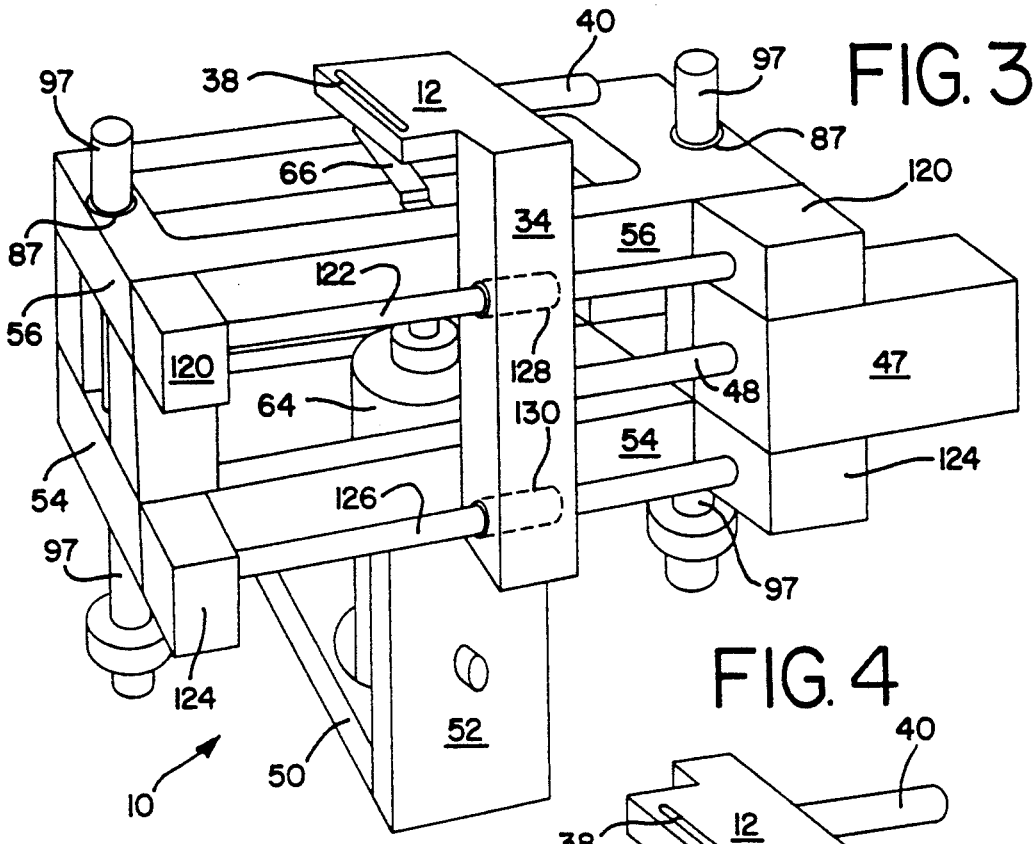
FIG. 3
FIG. 4
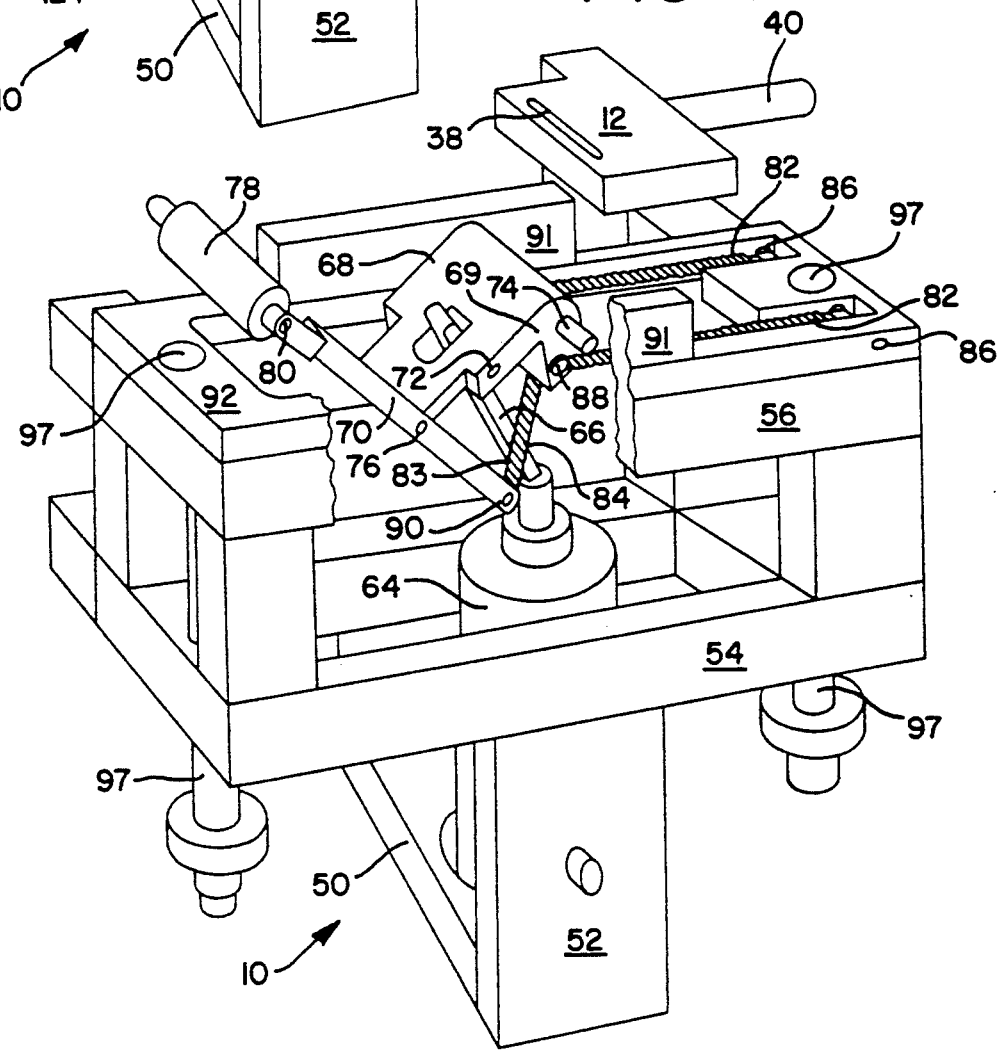

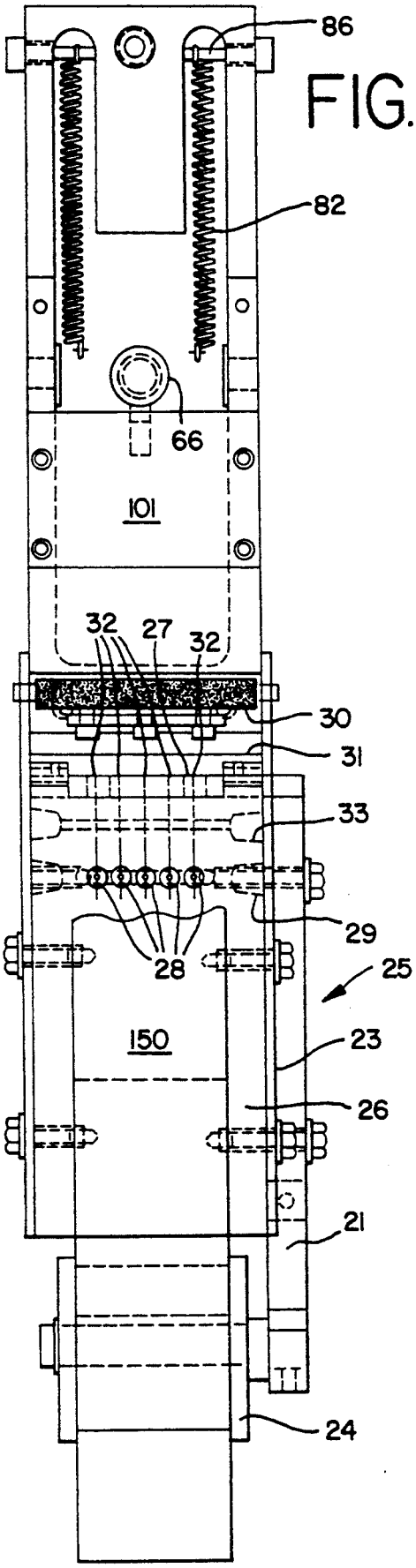
FIG. 5
FIG. 6
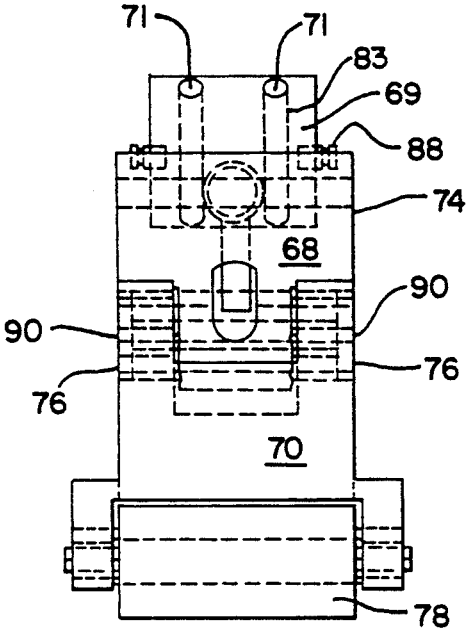
FIG. 7
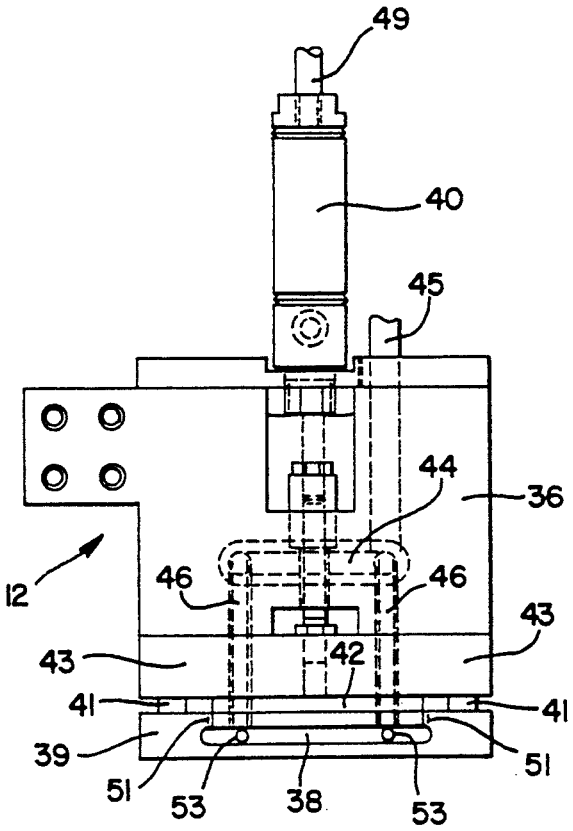

TAPING MACHINE

BACKGROUND OF THE INVENTION

The present invention relates generally to a machine for closing a carton with a length of tape that has a pull tab at one end which facilitates removing the tape when the carton is to be opened.

Cardboard boxes or cartons are conventionally used to store and transport numerous articles of modest weight. In many industrial uses of cardboard boxes the boxes could be reused if they were not damaged in their previous use. In these industrial uses there is usually a need to secure the box closed when it is being used. A customary way of securing closed a cardboard box is called, "fan folding". Fan folding, is a system of sequentially folding down three flaps of the cardboard box and then distorting or bending the fourth flap so that its one half locks under the first flap that was closed in the sequence. The step of distorting or bending the fourth flap takes its toll on the life expectancy of the box. About five uses of a cardboard box that has been fan folded is average. A cardboard box can also be taped close with various types of tape. Cartons that have been taped closed have an even shorter life expectancy than those that have been fan folded, and opening a taped carton without destroying it is a time consuming process.

It is therefore a primary objective of the present invention to provide a method for applying a length of adhesive tape to a carton while forming a pull tab at one end of the tape.

Another objective of the present invention is to provide a machine that will apply a length of tape to two surfaces of a carton that are at right angles to each other and fold one end of the tape back on itself to produce a pull tab that will facilitate removing of the tape.

Another objective of the present invention is to provide a machine that will apply a length of tape to a carton and form a pull tab at one end of the length of tape, the tape being of a type that will secure the carton close but can be removed without destroying the carton.

SUMMARY OF THE INVENTION

Briefly, a preferred embodiment of the present invention includes a machine that folds an end of the tape over on itself to produce a pull tab, cuts a length of tape, applies a first section of the length of tape to a first surface of a carton and a second section of the length of tape to a second surface of the carton which is at right angles to the first surface.

An important advantage of the present invention is that the carton can be quickly and easily opened.

It is another advantage of the present invention that the carton can be reused after being opened.

It is another advantage of the present invention is that cartons can be quickly and easily sealed and opened without destroying the carton.

These and other objects and advantages of the present invention will no doubt become apparent to those skilled in the art after having read the following detailed description of the preferred embodiment which are contained in and illustrated by the various drawing figures.

BRIEF DESCRIPTION OF THE DRAWING

FIG. 3 is a perspective view of a taper machine, that is an opposite handed machine compared to the machine seen in FIG. 1.

FIG. 4 is a perspective view of a taper machine, that is an opposite handed machine compared to the machine seen in FIG. 1, with portions broken away to better display the roller linkage mechanism.

FIG. 5 is a top view of the taper machine.

FIG. 6 is a top view of the roller linkage mechanism.

FIG. 7 is a top view of the tape holder and puller mechanism.

DETAILED DESCRIPTION OF THE PREFERRED EMBODIMENT

Figure 1:
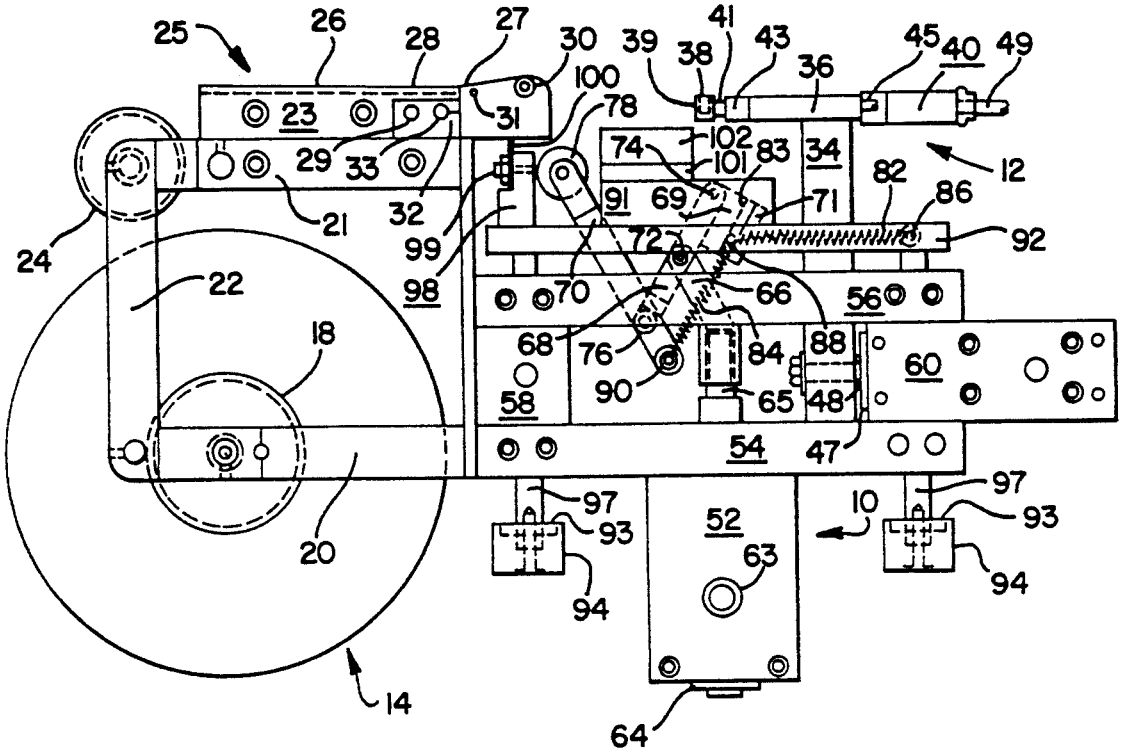
FIG. 1 is a side view of the machine.

In discussing the Figures of the drawing the terms top and bottom will be used to refer to the top and bottom of the machine as it is viewed in the Figures. In FIG. 1 the tape is dispensed from left to right, however the parts could be reversed and the tape could be dispensed from right to left. Thus terms such as the tape being pulled forward and the tape advancing, are intended to describe movement of the tape from its source to the tape puller.

The taper machine has a basic frame 10 to which all other components of the machine are attached. The basic frame includes a bottom plate 50 a pair of upright side plates 52 rigidly secured thereto, a lower longitudinal extending frame members 54, an upper longitudinal extending frame members 56, a pair of left spacer frame members 58 and a pair of right spacer frame members 60.

The tape dispenser 14 has a frame structure that is supported by the basic frame 10 of the taper machine and includes a lower support frame 20 and an upper support frame 21 that are interconnected by a vertical support 22. A tape hub 18 is mounted for rotation on the lower support frame 20. The tape hub 18 carries a supply of tape of a type that can be withdrawn from a cardboard carton without destroying its surface and does not accumulate on a cutter blade that is used to cut the tape. A nylon spool 24 is mounted for rotation at the juncture of the upper support frame 21 and the vertical support 22. The roll of tape carried by tape hub 18 has its non sticky side out. The tape hub 18 rotates counterclockwise such that the non-sticky side of the tape contacts the cylindrical surface of nylon spool 24 which rotates clockwise. An opened top tape groove assembly 25 is formed by a plate having a horizontal tape support surface 26 and a pair of side members 23. The tape groove assembly 25 is secured to the upper support frame 21. A plurality of suction hold down openings 28 are formed in the horizontal tape support surface 26 that open into a vacuum plenum. A vacuum source is connected through a fitting 29 to thus provide a vacuum at the horizontal tape support surface 26. The vacuum source is controlled so that vacuum at the horizontal tape support surface 26 can be activated or deactivated in accordance with the timing process of the taping machine. A wire 31 extends from one side member 23 to the other side member 23 at a level slightly above the surface 26. The tape supported by surface 26 passes under wire 31. The horizontal tape support surface 26 has an edge 27 over which the tape passes. A plurality of air jets 32 are located below the edge 27 for dispensing puffs of air for a purpose to be described. A source of air under pressure is connected at 33. A nylon roller 30 is rotatively mounted in members 23 such that it extends across the path of the tape, and as shall be discussed in more detail functions to prevent the tape from being pushed up when it is cut. It should be noted that the surface of roller 30 is provided with V-grooves which minimizes the surface area of roller 30 that will contact the sticky side of the tape and thus prevent the tape from becoming securely attached to roller 30.

The tape puller and tab former 12 is supported on a pedestal 34 which as will be discussed in greater detail is supported on the basis frame 10 and can be reciprocated to the left and right as seen in FIG. 1. The tape puller and tab former 12 has a slot 38 formed in its upper surface. An undercut 51 is formed in slot 38 that receives a clamp member 42 that is mechanically attached to bar 43 that is connected to a spring biased air cylinder 40. When the clamp member 42 is located in the undercut 51 formed in slot 38 the slot is open to receive the tape. The clamp 42 is biased by the springs in cylinder 40 into the undercut 51 formed in slot 38. When the cylinder 40 is actuated the spring biased clamp 42 is caused to move from the undercut 51 into the slot 38. Cylinder 40 has a source of air under pressure 49. A vacuum can be supplied to the slot 38 through a tube 45 which communicates with a vacuum plenum 44 which has two lumens 46 that have openings 53 in the bottom surface of slot 38.

With a piece of tape supported on the horizontal tape support surface 26 including a free end that extends forwardly of the edge 27 of surface 26, the tape puller and tab former 12 is moved toward the nylon roller 30. A vacuum is supplied to the suction hold down openings 28 located in surface 26 and the slot 38 at the same time. A puff of air is exhausted through the air jets 32 that causes the free end of the tape to lift up toward nylon roller 30 such that the tape puller and tab former 12 can move under the free end of the tape. As the tape puller and tab former 12 approaches nylon roller 30 the air cylinder 40 has been actuated to move the clamp 42 into 38 which shuts off the vacuum to the tab former. It should be noted at this point that the tape is orientated with its sticky side up. As the slot 38 moves completely under the free end of the tape the clamp cylinder 40 is deactivated causing the clamp 42 to open and allowing a vacuum to form in the slot. The vacuum causes the tape to be drawn down into the slot 38. A U-shaped cross section of the tape is drawn into the slot 38 and at the appropriate time in the cycle air cylinder 40 is activated and functions to clamp the U-shaped portion of the tape in the slot 38. At this time the vacuum in slot 38 and the suction hold down openings 28 is disengaged. The abutting surfaces of the U-shaped portion of the tape are both sticky sides of the tape and thus adhere to each other to form a pull tab that is not sticky on its outer surfaces. Upon release from the slot 38 this U-shaped portion of the tape will function as a pull tab for removing the tape from the carton when that is appropriate. At this stage of the cycle the tab which is securely secured to the tape puller and tab former 12 by clamp 42 serves to connect the tape to the tape puller and tab former 12. The tape puller and tab former 12 now reciprocates in the forward direction (to the right as seen in FIG. 1) pulling or unwinding tape from the tape hub 18 as it moves. When the tape puller and tab former reach its full forward position the vacuum in the suction hold down openings 28 is reactivated and functions to hold that side of the tape down when the cutter raises to sever the tape.

An air cylinder 64 is secured to the pair of upright side plates 52 by a trunnion mount 63. The air cylinder 64 has a piston shaft 65 extending vertically therefrom. A piston shaft extension member 66 includes a lower portion that has a vertical bore that receives shaft 65 and a tab portion that extends at a small angle to the vertical.

A cutter platform 92 has a pair of vertical shafts 97 that are secured thereto and extend downwardly therefrom. Shafts 97 slide in bushings 87 carried by the upper and lower longitudinal extending frame members 56 and 54 respectively (see FIG. 2). The lower ends of shafts 97 have base members 94 secured thereto the upper surfaces of which function as stops 93 that engage the bottom surface of lower longitudinal extending frame member 54 when the shafts are elevated.

The upper end of piston extension member 66 is connected by pivot means 72 to the mid portion of first link member 68. The upper end of first link member 68 is connected by pivot means 74 to a pair of vertical walls 91 that are integral parts of the cutter platform 92. As shall be discussed later in greater detail, a pair of springs 82 exert a counterclockwise force on first link member 68, about pivot means 74, that overcomes the clockwise component of force exerted on first link member 68 by piston extension member 66 such that in the initial upward movement of piston extension member 66 only a vertical force is exerted on the cutter platform 92 by air cylinder 64.

A cutter mounting bar 98 is secured to and extends upwardly from the upper surface of cutter platform 92. A cutter blade 100 is secured to the cutter mounting bar 98 by mechanical securing means 99. A neoprene pad 101 is secured to the upper edges of the pair of vertical walls 91 and functions as a base upon which is mounted a foam pad 102.

With one end of the tape held in slot 38 by clamp 42 and the other end held to the horizontal tape support surface 26 by suction hold down openings 28, air cylinder 64 is actuated causing shaft 65 to move vertically to elevate cutter platform 92 which elevates cutter blade 100 and the foam pad 102. The foam pad 102 presses the tape into contact with one surface of the carton to be closed and cutter blade 100 cuts the tape such that there is a free end portion of tape extending beyond the edge of the carton to which the tape has been applied. The elevation of cutter platform 92 continues until stops 93 carried by vertical shafts 97 contact the bottom surface of lower longitudinal extending frame member 54.

The air cylinder 64 continues to extend piston shaft 65 upwardly after the stops 93 have prevented further upward movement of the cutter platform 92. This continued upward movement of piston shaft 65 and piston extension member 66 causes first link member 68 to pivot about pivot means 74 in the clockwise direction. The lower end of first link member 68 is pivotally connected by pivot means 76 to a mid portion of second link member 70. A roller 78 is rotatively connected to the upper end of second link member 70. A pair of rods 83 are pivotally connected to the lower end of second link member 70 by pivot means 90. The first link member 68 has a block 69 integrally connected thereto which has a pair of cylindrical holes 71 bored therethrough. Cylindrical holes 71 are dimensioned to receive rods 83. The lower ends of cylindrical holes 71 are counter-bored to receive the upper ends of springs 84 which surround rods 83. The lower ends of springs 84 react against the pivot means 90. A pair of spring connecting rods 88 projects outwardly from each side of the block 69 and function to anchor horizontal springs 82. The other end of horizontal springs 82 are connected to spring connecting rod 86 that are anchored in the cutter platform 92. As previously discussed upward movement of the piston shaft 65 caused the cutter platform 92 to move upwardly until the shoulders or stops 93 encountered the lower surfaces of lower longitudinal extending frame members 54.

It should be noted that horizontal springs 82 exert a counterclockwise torque, about pivot means 74, on first link member 68 during the initial elevation of the cutter platform 92 which cancels out the clockwise torque that is exerted on first link member 68 by the piston 65. After stops 93 have been encountered, further upper movement of the piston 65 causes first link member 68 to pivot about pivot means 74 in the clockwise direction. The bottom end of first link member 68 exerts a vertical component of force on second link member 70 which causes roller 78 to move upwardly. As first link member 68 pivots clockwise about pivot means 74, the attitude of block 69 and the cylindrical holes 71 formed therein change. This change in attitude of holes 71 along with the repositioning of the bottom end of second link member 70 allows rods 83 to slide into cylindrical holes 71 and exerts a force on the lower end of second link member 70 attempting to pivot it in the clockwise direction about pivot means 76. This attempt to pivot second link member 70, in the clockwise direction, is transmitted to the roller 78 causing it to attempt to move to the right as seen in FIG. 1. If the roller 78 is prevented from moving to the right as a result of its engagement with a surface of a carton, then this force functions to press the tape up against the surface of the carton as the roller 78 moves upwardly over the tape. It should be noted that this force is being exerted by springs 84.

Although FIG. 1 illustrates a composite view of the complete taper machine some of the details that are not apparent from FIG. 1 will be discussed with reference to the other Figures.

Figure 2:
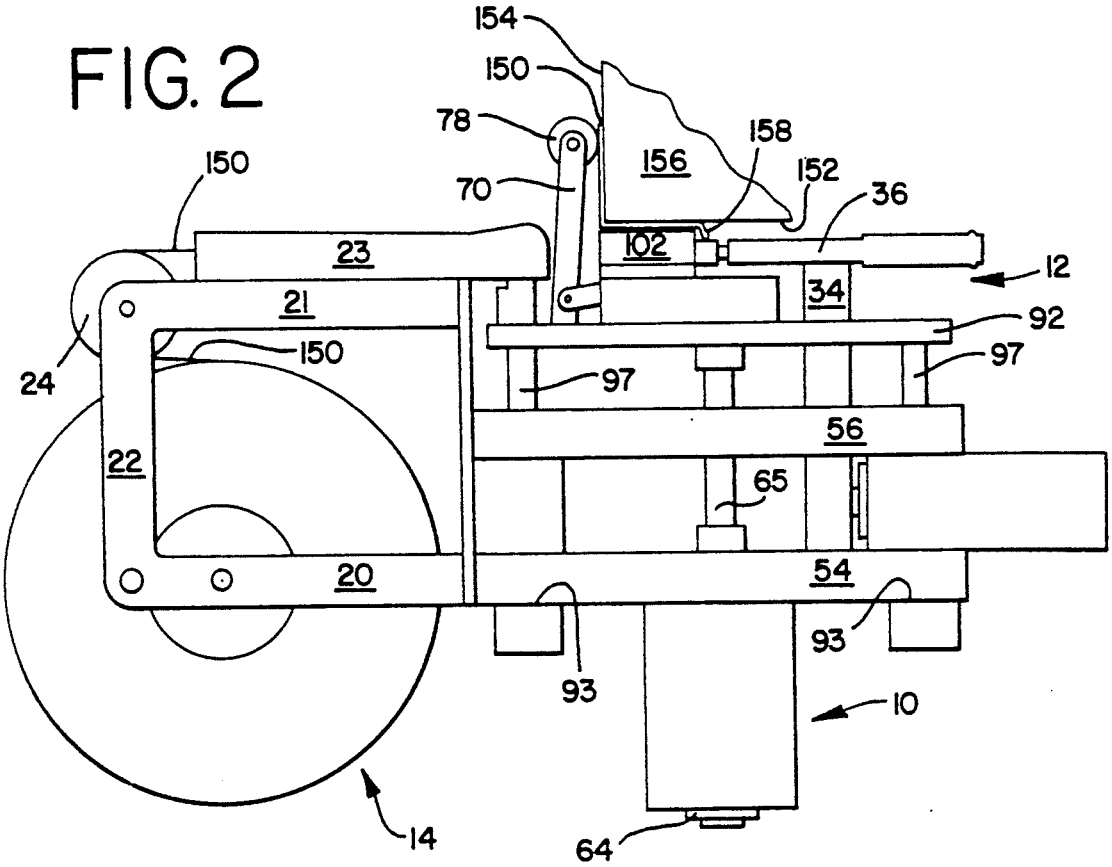
FIG. 2 is a side view of the taper machine, shown in the process of applying tape to the surfaces of a carton.

FIG. 2 shows the taper machine in the process of applying a piece of tape 150 to a horizontal surface 152 and to a vertical surface 154 of a carton 156. In this view the stops 93 are in engagement with the lower surface of the lower longitudinal extending frame member 54 which has stopped upward movement of cutter platform 92 after the cutter blade 100 severed the tape 150. As the tape was being severed foam pad 102 was pressing a section of the tape against the horizontal surface 152 of carton 156. Continued extension of piston shaft 65 after cutter platform 92 reached its upper limit caused second link member 70 and roller 78 to elevate and roll the severed end of the tape 150 against the vertical surface 154 of the carton 156. As seen in FIG. 2 the pull tab 158 has moved out of the slot 38 and extends perpendicular to the horizontal surface 152.

Referring now to FIG. 3 which is a perspective view of a taper machine, that is an opposite handed machine as that seen in FIG. 1. It should be noted that FIG. 2 is a sketch of the taper machine that is intended to illustrate the mechanism for reciprocating the tape puller and tab former 12, and components of the machine not essential to an understanding of this function may be omitted. A pair of upper rod mounting means 120 are secured to the upper longitudinal extending frame member 56 into which are secured the opposite ends of a horizontally orientated upper slide rod 122. A pair of lower rod mounting means 124 are secured to the lower longitudinal extending frame member 54 into which are secured the opposite ends of lower slide rod 126. Rods 124 and 126 are parallel and extend through upper 128 and lower 130 cylindrical bushings respectively that are carried by pedestal 34. An air actuation cylinder 47 is secured to a right spacer frame member 60 between an upper 120 and lower 124 rod mounting means. The air actuation cylinder 47 has a piston shaft 48 the free end of which is connected to pedestal 34. When air actuation cylinder 47 is actuated and piston shaft 48 is extended causing pedestal 34 and the tape puller and tab former 12 to move to the left as seen in FIG. 3. Likewise when air actuation cylinder 47 is actuated and piston shaft 48 is retracted pedestal 34 and the tape puller and tab former 12 move to the right as seen in FIG. 3.

Bushings 87, that receive the vertical shafts 97 for sliding movement therethrough, are identified in FIG. 3.

Referring now to FIG. 4, which is a perspective view of a taper machine, of the same hand as that seen in FIG. 1. It should be noted that this figure is a sketch intended to illustrate how the roller actuation linkage is orientated with respect to the other components of the taper machine. Components that are not essential to the purpose of this sketch may be broken away or not shown. It can be seen in FIG. 4, that the central portions of upper 56 and lower 54 longitudinal extending frame members are open to accommodate the cylinder 64 and the roller linkage mechanism. After the stops 93 have prevented further upward movement of the cutter platform 92, further extension of air cylinder 64 extends piston shaft 65 and piston extension member 66 upwardly. This continued upward movement of piston shaft 65 and piston extension member 66 causes first link member 68 to pivot about pivot means 74 in the clockwise direction. The pivot means 74 are anchored in vertical walls 91, one of which is shown in its entirety and the other of which has been broken away to better show the linkage mechanism that lies behind it. The lower end of first link member 68 is pivotally connected by pivot means 76 to a mid portion of second link member 70. A roller 78 is rotatively connected to the upper end of second link member 70. A pair of rods 83 are pivotally connected to the lower end of second link member 71 by pivot means 90. The first link member 68 has a block 69 integrally connected thereto which has a pair of cylindrical holes 71 bored therethrough. Cylindrical holes 71 are dimensioned to receive rods 83. The lower ends of cylindrical holes 71 are counter-bored to receive the upper ends of springs 84 which surround rods 83. The lower ends of springs 84 react against the pivot means 90. A spring connecting rod 88 projects outwardly from each side of block 69 and function to anchor horizontal springs 82. The other end of horizontal springs 82 are connected to spring connecting rod 86 that are anchored in the cutter platform 92.

Referring now to FIG. 5 which is a top view of the taper machine. The opened top tape groove assembly 25 includes a horizontal plate 26 that has a groove, the width of the tape, formed in its upper surface that supports the tape. A pair of side members 23 are secured to the sides of the tape groove assembly that serve to support the ends of roller 30. The tape groove assembly 25 is secured to the upper support frame 21. A plurality of suction hold down openings 28 are formed in the wide shallow groove of plate 26 that open into a vacuum plenum. A vacuum source is connected through a fitting 29 to thus provide a vacuum at the horizontal surface of plate 26. The vacuum source is controlled so that vacuum at the horizontal surface of plate 26 can be activated or deactivated in accordance with the timing process of the taping machine. A pair of side members 23 are secured to plate 26 that function to support roller 30. A wire 31 extends from one side member 23 to the other side member 23 at a level above the surface 26. The tape supported by surface 26 passes under wire 31. The horizontal tape support surface 26 has an edge 27 over which the tape passes. A plurality of air jets 32 are located below the edge 27 for dispensing puffs of air to blow the cut free end of the tape upwardly and prevent it from sagging such that when the tape puller and tab former 12 moves toward edge 27 the tape is properly orientated to recline on the upper surface of the tape puller and tab former 12. A source of air under pressure is connected at 33. A nylon roller 30 extends across the path of the tape and functions to prevent the tape from being blown up to far by the puffs of air. It should be noted that the surface of roller 30 is covered with V-grooves which minimizes the surface area of roller 30 that will contact the sticky side of the tape to thus prevent the tape from becoming securely attached to roller 30.

FIG. 6 is a top view of the roller linkage mechanism. First link member 68 pivots about pivot means 74 and has a block 69 integrally connected thereto which has a pair of cylindrical holes 71 bored therethrough. The lower end of first link member 68 is pivotally connected by pivot means 76 to a mid portion of second link member 70. A roller 78 is rotatively connected to the upper end of second link member 70. A pair of rods 83 (not shown in FIG. 6) are pivotally connected to the lower end of second link member 70 by pivot means 90. Spring connecting rods 88 projects outwardly from each side of block 69 and function to anchor one end of each horizontal springs 82 (not shown in FIG. 6).

FIG. 7 is a top view of the tape holder and puller mechanism 12. The tape puller and tab former 12 includes a base device 36 that has a pair of rods 41 anchored therein and protruding therefrom. A spaced edge section 39, is secured to the free ends of the pair of rods 41 such that there is a space between the base device 36 and the spaced edge section 39. The spaced edge section 39 has a slot 38 formed in its upper surface. A bar 43 is mounted to slide on the rods 41 in the space between base device 36 and the spaced edge section 39. The width of bar 43 is less than the space between base device 36 and spaced edge section 39 which permits bar 43 to slide back and forth between device 36 and section 39. An undercut 51 is formed in slot 38 that receives a clamp member 42 that is an extension of bar 43. The vertical surface of clamp member 42 functions as a vertical wall of slot 38 when the slot is open and the tape engaging surface of the clamp member when the clamp member 42 closes. When the clamp member 42 is located in the undercut 51 formed in slot 38 the slot is open to receive the tape. When bar 43 slides from adjacent base device 36 to a location adjacent spaced edge section 39 it causes clamp member 42 to move out of the undercut 51 formed in slot 38 toward the opposite side of slot 38. In doing so, if there is tape in the slot, the clamp member 42 will secure the tape in the slot by pressing and holding it against the slot's opposite side wall. The bar 43 is connected to a spring biased air cylinder 40. The clamp 42 is biased by the springs in cylinder 40 into the undercut 51 formed in slot 38. When the cylinder 40 is actuated the spring biased clamp 42 is caused to move from the undercut 51 into the slot 38. Cylinder 40 has a source of air under pressure 49. A vacuum can be supplied to the slot 38 through tube 45 which communicates with a vacuum plenum 44 which has two lumens 46 that open into the bottom of slot 38. The openings 53 of lumens 46 in the bottom of slot 38 are closed by clamp 42 when clamp 42 is located in slot 38. At the point in the machine cycle when the tape puller and tab former 12 moves under the free end of the tape, the clamp 42 is stored in the undercut 51 and there is a vacuum in the slot 38, the free end of the tape is drawn down into the slot 38. It should be noted at this point that the tape is orientated with its sticky side up. Since the free end of the tape overlies the width of slot 38, a U-shaped cross section of the tape is drawn into the slot 38 and at the appropriate time in the cycle the cylinder 40 is activated, shifting clamp 42 toward the opposite side of slot 38 and securing the U-shaped portion of the tape in the slot 38. At this time the vacuum in slot 38 has been shut off by the clamp 42. The abutting surfaces of the U-shaped portion of the tape are both sticky sides of the tape and are thus adhere to each other to form a pull tab that is not sticky on either outer surface. Upon release from the slot 38 this U-shaped portion of the tape will function as a pull tab for removing the tape from the carton when that is appropriate. However at this stage of the cycle, the tab which is securely secured to the base device 36 by clamp 42 serves to connect the tape to the tape puller and tab former 12. The tape puller and tab former 12 now reciprocates in the forward direction (upwardly as seen in FIG. 7) pulling or unwinding tape from the tape hub 18 as it moves.

Although the present invention has been described in terms of specific embodiments, it is anticipated that alterations and modifications thereof will no doubt become apparent to those skilled in the art. It is therefore intended that the following claims be interpreted as covering all such alterations and modifications as fall within the true spirit and scope of the invention.

What is claimed is:

1. A taping machine comprising:

a frame, a tape dispenser mounted on the frame, a horizontal tape support surface mounted on the frame for supporting dispensed tape with the sticky side up, said horizontal tape support surface having openings formed therein that are connected to a vacuum source to thus create a vacuum on the surface of said horizontal tape support surface that holds the tape to the surface, said horizontal tape support surface terminating in an edge that is remote from the tape dispenser, a support arm mounted on the frame such that it is parallel to but spaced from said edge and functions to support a free end portion of the tape that extends beyond said edge, an air jet located below said edge and directed such that when it discharges a puff of air the free end of the tape that extends beyond said support arm is maintained at a level above said support arm, a tape puller and tab former mounted on the frame for horizontal reciprocal movement toward and away from said tape dispenser, said tape puller and tab former having an upper horizontal surface that has a slot formed therein, said slot being dimensioned such that it is wider then the tape to be used with the machine, a clamp within said slot and movable toward a side wall of said slot, said clamp being biased away from said side wall, a power actuator for moving said clamp toward said side wall, a vacuum source and control device for supplying and releasing a vacuum to the slot, such that when the tape puller and tab former moves toward said support arm the clamp is biased away from said side wall, the vacuum source and control device provides a vacuum in the slot which pulls a U-shaped portion of the tape into the slot, the clamp is then actuated to secure the U-shaped portions in place, and the tape puller and tab former is reciprocated away from said support arm pulling tape from said tape dispenser, a tape applicator and cutter mounted on said frame for reciprocation relative thereto, including a blade having a horizontal cutting edge that cuts through the tape as it raises between said edge and said support arm and a pad that engages the undersurface of the tape and presses the upper or sticky surface of the tape against the carton.

2. The invention as set forth in claim 1, in which said tape applicator and cutter also includes a roller that moves upwardly to press the just cut end of the tape against the side of the carton.

3. The invention as set forth in claim 1, in which a support having said blade and said pad on its upper surface is vertically slidable mounted relative to said frame, a trunnion mounted air cylinder on said frame, and the piston portion of said air cylinder, when expanded, exerts an upward force on said support causing it to move upwardly.

4. The invention as set forth in claim 3, wherein stops are provided on said support that engage said frame to limit upward movement of said support relative to said frame, said piston portion of said air cylinder being pivotally connected to the mid portion of a first link of a linkage system, one end of said first link being pivotally connected to said support, said upward force by the air cylinder being exerted on said support through the pivotal connection of said one end of said first link to said support, a second link in said linkage system being pivotally connected at a mid point to the other end of said first link, a roller carried by one end of said second link, after said stops are engaged halting further upper movement of said support, further extension of said air cylinder will cause said first link to pivot about its pivotal connection to the support and said roller to move upward and inward toward a carton to thus apply the tape to the side of the carton.

5. A taping machine comprising:

a frame a tape dispenser mounted on said frame, a tape puller and tab former mounted on the frame for horizontal reciprocal movement relative to said frame, a support mounted on said frame for reciprocation relative thereto, a tape applicator and cutter mounted on said support, including a blade having a horizontal cutting edge that cuts through the tape as it raises and a pad that engages the undersurface of the tape and presses the upper or sticky surface of the tape against a carton, an air cylinder trunnion mounted on said frame, such that when the piston portion of said air cylinder, extends, an upward force is exerted on said support causing it to move upwardly, wherein stops are provided on said support that engage said frame to limit upward movement of said support relative to said frame, said piston portion of said air cylinder being pivotally connected to the mid portion of a first link of a linkage system, one end of said first link being pivotally connected to said support, said upward force by the air cylinder being exerted on said support through the pivotal connection of said one end of said first link to said support, said tape applicator and cutter also includes a roller that moves upwardly to press the just cut end of the tape against the side of the carton, a second link in said linkage system being pivotally connected at a mid point to the other end of said first link, said roller carried by one end of said second link, after said stops are engaged halting further upper movement of said support, further extension of said air cylinder will cause said first link to pivot about its pivotal connection to the support and said roller to move upwardly and inwardly toward a carton to thus roll the tape against the side of the carton.

* * * * *